US009895002B1

(12) United States Patent
Cooke et al.

(10) Patent No.: US 9,895,002 B1
(45) Date of Patent: Feb. 20, 2018

(54) FOLDING FRAMES FOR FURNITURE AND BEDDING

(71) Applicant: Hickory Springs Manufacturing Company, Hickory, NC (US)

(72) Inventors: Dennis R. Cooke, Hickory, NC (US); Jason L. Porter, Hickory, NC (US)

(73) Assignee: Hickory Springs Manufacturing Company, Hickory, NC (US)

( * ) Notice: Subject to any disclaimer, the term of this patent is extended or adjusted under 35 U.S.C. 154(b) by 619 days.

(21) Appl. No.: 14/546,838

(22) Filed: Nov. 18, 2014

Related U.S. Application Data

(60) Provisional application No. 61/909,863, filed on Nov. 27, 2013.

(51) Int. Cl.

| | |
|---|---|
| ***A47C 17/16*** | (2006.01) |
| ***A47C 17/17*** | (2006.01) |
| ***A47C 17/175*** | (2006.01) |
| ***A47C 1/02*** | (2006.01) |

(Continued)

(52) U.S. Cl.
CPC ..... *A47C 17/162* (2013.01); *A47B 3/00* (2013.01); *A47C 1/02* (2013.01); *A47C 3/00* (2013.01); *A47C 17/17* (2013.01); *A47C 17/1756* (2013.01)

(58) Field of Classification Search
CPC ..... A47C 17/132; A47C 17/16; A47C 17/161; A47C 17/162; A47C 17/163; A47C 17/165; A47C 17/1655; A47C 17/17; A47C 17/175; A47C 17/1753; A47C 17/1756;

(Continued)

(56) References Cited

U.S. PATENT DOCUMENTS

RE4,990 E 7/1872 Crosby
789,903 A * 5/1905 Fenner ..... A47C 17/1756 5/47

(Continued)

FOREIGN PATENT DOCUMENTS

DE 608156 C 1/1935
DE 1745766 U 5/1957

(Continued)

OTHER PUBLICATIONS

Cubed 90 Deluxe, YouTube video screenshots (video available at http://www.youtube.com/watch?v=M8HVAj8yRos), published on Apr. 8, 2013.

(Continued)

*Primary Examiner* — Robert G Santos
(74) *Attorney, Agent, or Firm* — Perkins Coie LLP

(57) ABSTRACT

A sleeper sofa having a bridge joint to inhibit bowing between frames in a sleeper position is provided although other folding articles are contemplated. The sleeper sofa has a first frame section and a second frame section foldable/pivotable from a first sitting position to a second sleeping position. When in the sleeping position, the bridge joint extends under and between the first and second frame section to provide support to inhibit bowing at the junction between the first and second frame section. The bridge joint includes a pivot axle and an anti-buckling member coupled to a pivot guide having a track. The anti-buckling member travels in the track as the first and second frames are unfolded about the pivotal axle.

15 Claims, 6 Drawing Sheets

(51) Int. Cl.
*A47C 3/00* (2006.01)
*A47B 3/00* (2006.01)

(58) Field of Classification Search
CPC ... A47C 17/20; A47C 17/207; A47C 17/2073; A47C 17/2076
USPC ..... 5/37.1, 38, 41, 42, 43, 44.1, 47, 48
See application file for complete search history.

(56) References Cited

U.S. PATENT DOCUMENTS 820,826 A * 5/1906 Seng ..... A47C 17/175 16/347
891,351 A 6/1908 Adolph et al.
1,012,558 A * 12/1911 Jeffcott ..... A47C 17/2076 5/13
1,381,293 A 6/1921 Freeman
1,811,936 A 6/1931 Hutchins
2,059,978 A * 11/1936 Wunderlich ..... A47C 17/1756 5/47
2,107,993 A * 2/1938 Fox ..... A47C 17/1756 16/333
2,126,588 A 8/1938 Thum
2,209,880 A * 7/1940 Fox ..... A47C 17/1756 16/357
2,224,825 A * 12/1940 Krakauer et al. .. A47C 17/1756 16/333
2,236,351 A * 3/1941 Krakauer ..... A47C 17/1756 16/333
2,287,596 A 6/1942 Bell
2,291,391 A 7/1942 Krakauer
2,295,083 A * 9/1942 Jonassen ..... A47C 17/1756 16/302
2,321,708 A * 6/1943 Sklar ..... E05D 11/06 16/331
2,330,059 A * 9/1943 Krakauer et al. .. A47C 17/1756 5/47
2,334,493 A * 11/1943 Johnson ..... A47C 17/1756 16/288
2,341,616 A * 2/1944 Hoffman ..... A47C 17/1756 16/347
2,395,424 A * 2/1946 O'Neil ..... A47C 17/1756 5/47
2,429,260 A * 10/1947 Coopersmith ..... A47C 17/17 5/47
2,437,580 A * 3/1948 Wilson ..... A47C 17/1756 5/47
2,437,949 A * 3/1948 Fox et al. ..... A47C 17/1756 5/47
2,447,683 A * 8/1948 Boiu ..... A47C 17/1756 5/47
2,493,096 A * 1/1950 Wilson ..... A47C 17/1756 5/47
2,495,413 A * 1/1950 Harman ..... A47C 17/162 5/47
2,501,464 A * 3/1950 Bernstein ..... A47C 17/1756 5/47
2,534,175 A 12/1950 Lorenz
2,567,263 A * 9/1951 Wilson ..... A47C 17/1756 16/333
2,582,904 A 1/1952 Harman
2,601,683 A * 7/1952 Bebry et al. ..... A47C 17/1756 16/287
2,602,169 A * 7/1952 McDaniel ..... A47C 17/2076 5/23
2,625,693 A * 1/1953 Raginsky ..... A47C 17/1756 217/60 R
2,629,883 A * 2/1953 Nowell ..... A47C 17/1756 16/302
2,634,430 A 4/1953 Rogers
2,651,054 A * 9/1953 Krakauer ..... A47C 17/1756 5/47
2,664,145 A 12/1953 Creveling et al.
2,664,574 A 1/1954 Newborn
2,672,625 A * 3/1954 Rhodes et al. ..... A47C 17/1756 5/47
2,694,814 A * 11/1954 Doner ..... A47C 17/1756 297/354.13
2,719,985 A * 10/1955 Lichter et al. ..... A47C 17/1756 5/47
2,740,131 A * 4/1956 Vogel et al. ..... A47C 17/2076 5/309
2,755,487 A * 7/1956 Harman ..... E05D 11/1014 33/123
3,085,257 A 4/1963 Laemmle
3,247,527 A * 4/1966 Mizelle ..... A47C 17/17 5/48
3,317,930 A 5/1967 Wiberg
3,345,651 A 10/1967 Fox
3,432,203 A 3/1969 Cavalli
3,856,347 A * 12/1974 Bell ..... A47C 17/162 297/371
4,074,371 A 2/1978 Lindbloom et al.
4,204,287 A 5/1980 Hauck et al.
4,321,717 A 3/1982 Serra
4,365,369 A 12/1982 Plume et al.
4,402,096 A 9/1983 Atimichuk
4,512,048 A 4/1985 Isham et al.
4,563,037 A * 1/1986 Tiffany ..... A47C 17/207 297/105
4,625,346 A 12/1986 Quackenbush et al.
4,639,953 A 2/1987 McElmurry et al.
4,672,696 A 6/1987 Horenkamp et al.
5,097,544 A 3/1992 Barabas
5,231,710 A 8/1993 Markel et al.
5,479,665 A 1/1996 Cassidy et al.
5,505,513 A 4/1996 Carsner et al.
5,745,935 A 5/1998 Arft et al.
5,787,522 A 8/1998 Swihart et al.
5,904,401 A 5/1999 Alberda et al.
6,082,805 A 7/2000 Gray et al.
6,209,154 B1 * 4/2001 Huang ..... A47C 17/162 297/354.13
6,341,392 B1 1/2002 Makinen et al.
6,651,274 B2 11/2003 Swihart et al.
6,725,473 B2 4/2004 Grossman et al.
6,904,628 B2 6/2005 Murphy et al.
7,685,655 B1 3/2010 Delmestri et al.
7,748,061 B2 7/2010 Pine et al.
7,827,629 B1 11/2010 Guillot et al.
8,011,034 B2 9/2011 Hoffman et al.
8,739,330 B2 6/2014 Smith et al.
8,875,321 B2 * 11/2014 Kanthasamy ..... A47C 17/17 297/354.12
8,984,680 B2 3/2015 Smith et al.
9,179,780 B2 * 11/2015 Kanthasamy ..... A47C 17/17
2003/0061655 A1 * 4/2003 Swihart ..... A47C 17/1756 5/37.1
2010/0269255 A1 10/2010 Kanthasamy et al.
2012/0042448 A1 * 2/2012 Kanthasamy ..... A47C 17/17 5/37.1
2015/0267448 A1 * 9/2015 Kanthasamy ..... A47C 17/1756 5/37.1

FOREIGN PATENT DOCUMENTS

DE 8118374.7 3/1982
DE 3243200 A1 5/1984
DE 202008009315 U1 10/2008
EP 477148 A1 3/1992
EP 1230877 A1 8/2002
FR 726500 A 5/1932
FR 1010886 A 6/1952
FR 2488116 A1 2/1982
FR 2699798 A1 7/1994
FR 2895655 B1 3/2010
GB 358338 A 10/1931
GB 365766 A 1/1932
GB 366171 A 2/1932
GB 819933 A 9/1959
GB 2079147 A 1/1982

(56) References Cited

FOREIGN PATENT DOCUMENTS

| | | |
|---|---|---|
| GB | 322522 | 10/2003 |
| GB | 823014 | 1/2009 |
| JP | 3062390 U | 10/1999 |

OTHER PUBLICATIONS

Cubed sofa bed from Innovation, YouTube video screenshots (video available at http://www.youtube.com/watch?v=o6pd8OgdKgU), uploaded on Jun. 2, 2010.

* cited by examiner

FOLDING FRAMES FOR FURNITURE AND BEDDING

CROSS-REFERENCE TO RELATED PATENT APPLICATIONS

The present application claims priority to and benefit from U.S. Provisional Patent Application No. 61/909,863 titled "Folding Frames for Furniture and Bedding" filed on Nov. 27, 2013, the entire content of which is herein expressly incorporated by reference.

BACKGROUND

Foldable furniture is used in a variety of applications including tables, recliners, portable apparatuses, and convertible sofas (which are sometimes referred to as sleeper sofas). Generally, foldable furniture has multiple positions. In one of the positions, the foldable furniture is unfolded.

With reference to convertible sofas, for ease of reference, the convertible sofa has a bed frame folded into the sofa. The bed frame is unfolded to form a sleeping surface. Generally, the sleeping surface includes three frame parts, which will be referred to as the leg frame section, the torso frame section, and the frame head section. The head section is conventionally considered the portion of the bed frame between the arm rests of the sofa or, when no arm rests are included, the bed frame generally above the sofa base or casing.

The bed frame where it folds, e.g., between the leg and torso frame sections and between the torso and head frame sections, may bend or bow with the application of pressure or weight. This problem with foldable furniture is exasperated by the length and width of the furniture and the weight applied. Again, with specific reference to a sleeper sofa, the seam or junction between the head frame and torso frame may be inhibited from bowing or bending by the sofa base or casing.

Thus, against this background, it would be desirable to provide a folding frame for furniture to decrease or inhibit the bending or bowing of the frame at the junction between foldable parts.

SUMMARY

This Summary is provided to introduce a selection of concepts in a simplified form that are further described below in the Detailed Description. This Summary, and the foregoing Background, is not intended to identify key aspects or essential aspects of the claimed subject matter. Moreover, this Summary is not intended for use as an aid in determining the scope of the claimed subject matter.

A folding apparatus is provided where at least a first member and a second member unfold such that one member moves up to about 180 degrees with respect to the other member. The members are coupled by a bridge joint that provides support at the junction or seam between the first and second member such that the bridge joint resists or inhibits force on a side opposite the bridge joint from causing a bow or bend between the first and second members.

The bridge joint in certain embodiments may include a pivot beam having a pivot pin or axle and an anti-buckling pin, and a bridge beam having a pivot guide. The pivot guide may include a track completely or partially encircling the pivot pin. The anti-buckling pin travels in the track about the pivot pin while the first and second members are folded or unfolded.

In certain aspects, the folding apparatus comprises a sleeper sofa. In other aspects, the folding apparatus comprises a recliner. In yet other aspects, the folding apparatus comprises a table.

These and other aspects of the present system and method will be apparent after consideration of the Detailed Description and Figures herein.

DRAWINGS

Non-limiting and non-exhaustive embodiments of the present invention, including the preferred embodiment, are described with reference to the following figures, wherein like reference numerals refer to like parts throughout the various views unless otherwise specified.

DETAILED DESCRIPTION

The technology of the present application is described more fully below with reference to the accompanying figures, which form a part hereof and show, by way of illustration, specific exemplary embodiments. These embodiments are disclosed in sufficient detail to enable those skilled in the art to practice the technology disclosed. However, embodiments may be implemented in many different forms and should not be construed as being limited to the embodiments set forth herein. The following detailed description is, therefore, not to be taken in a limiting sense.

The technology of the present application is described with respect to convertible or sleeper sofas, and specifically to sleeper sofas, designed for use in recreational vehicles. However, the technology of the present application is applicable to other foldable furniture including, for example, tables, recliners, portable apparatuses, and the like. Moreover, the technology of the present application will be described with relation to exemplary embodiments. The word "exemplary" is used herein to mean "serving as an example, instance, or illustration." Any embodiment described herein as "exemplary" is not necessarily to be construed as preferred or advantageous over other embodiments. Additionally, unless specifically identified otherwise, all embodiments described herein should be considered exemplary.

Figure 1:
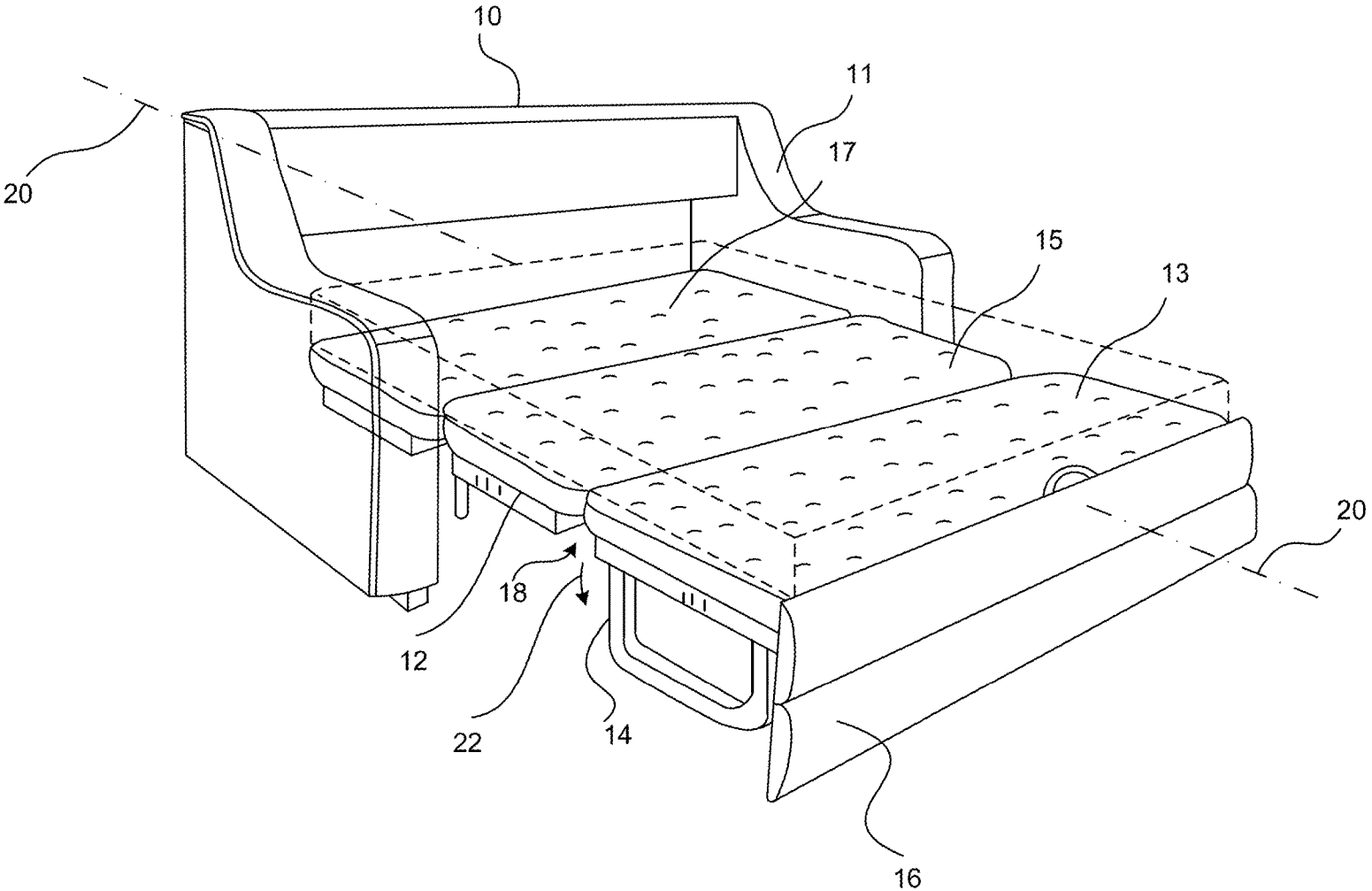
FIG. 1 (Prior Art)
FIG. 1 depicts a perspective view of a conventional convertible sofa.

A convertible sofa 10 is shown in FIG. 1. The convertible sofa 10 includes a sofa frame 11 having a sofa base, a back rest, and a plurality of arm rests. The sofa frame is sometimes referred to as a casing or the like. The convertible sofa 10 includes a foldable bed frame 12 that is shown unfolded in the sleeping position in FIG. 1. The bed frame 12 includes leg frame section 13, a torso frame section 15, and a head frame section 17. The bed frame 12 may be provided with a mattress or a mattress may be placed on the bed frame, as shown in phantom in FIG. 1. Typically, the leg frame section 13 is supported by a U-frame leg 14. The U-frame leg 14 may be parallel to the longitudinal axis 20 of the bed frame 12 as shown or the U-frame leg 14 may traverse the longitudinal axis 20 similar to the front casing panel 16 of the sofa.

As can be appreciated, the torso frame section 15 and leg frame section 13 are joined at a fold line 18 of the bed frame 12. The fold line 18 is typically a weak point in the frame and the bed frame 12 has a tendency to bow or bend in the direction shown by arrow 22 when weight is applied to the bed frame 12. Conventionally, the bowing or bending is only resisted by the frames and cushions pressing laterally on themselves, which is frequently insufficient to resist the downward movement. Of course, legs or other supports would tend to resist the downward movement as well. References to down, up, forward, left, right, rear, and the like are for purposes of orientation and should not be construed as limiting.

Figure 2:
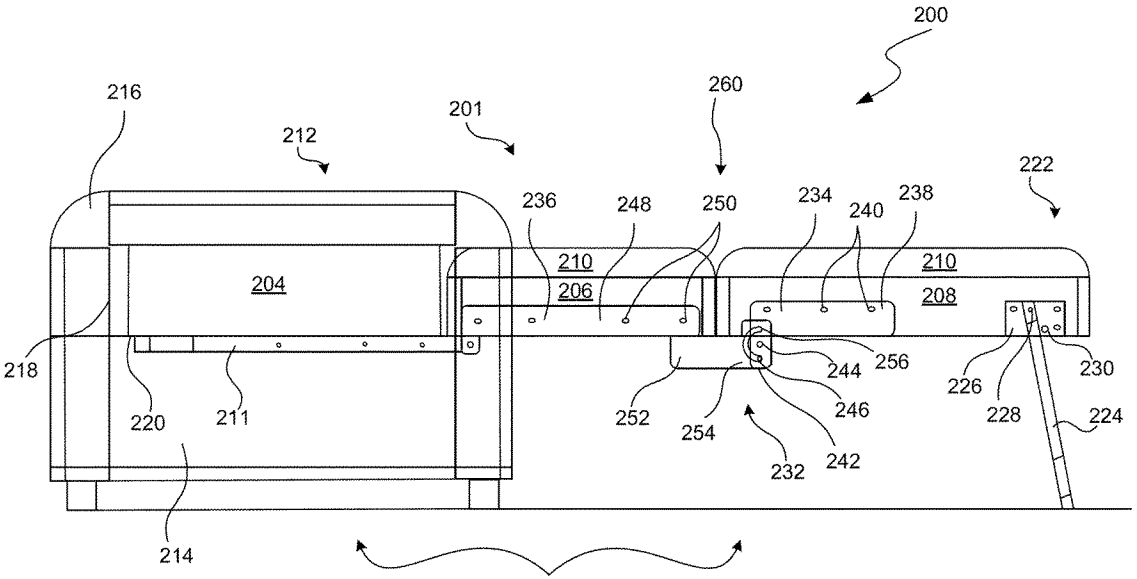
FIG. 2 depicts a side elevation, line view of a convertible sofa incorporating the technology of the present application.

FIG. 2 shows a side elevation view of a convertible sofa 200 incorporating the technology of the present application. As will be explained below, the bed frame of the convertible sofa 200 provides a bridge joint extending between the torso frame section and the leg frame section. The bridge joint acts as a reinforcing member preventing the bed frame from bowing or bending at the junction between the two frame section. While described with reference to a sleeper sofa having a leg frame section and a torso frame section, the bridge joint may extend between any foldable apparatus's first member and second member to resist or inhibit bowing due to weight or force applied to a side opposite the bridge joint.

Figure 3:
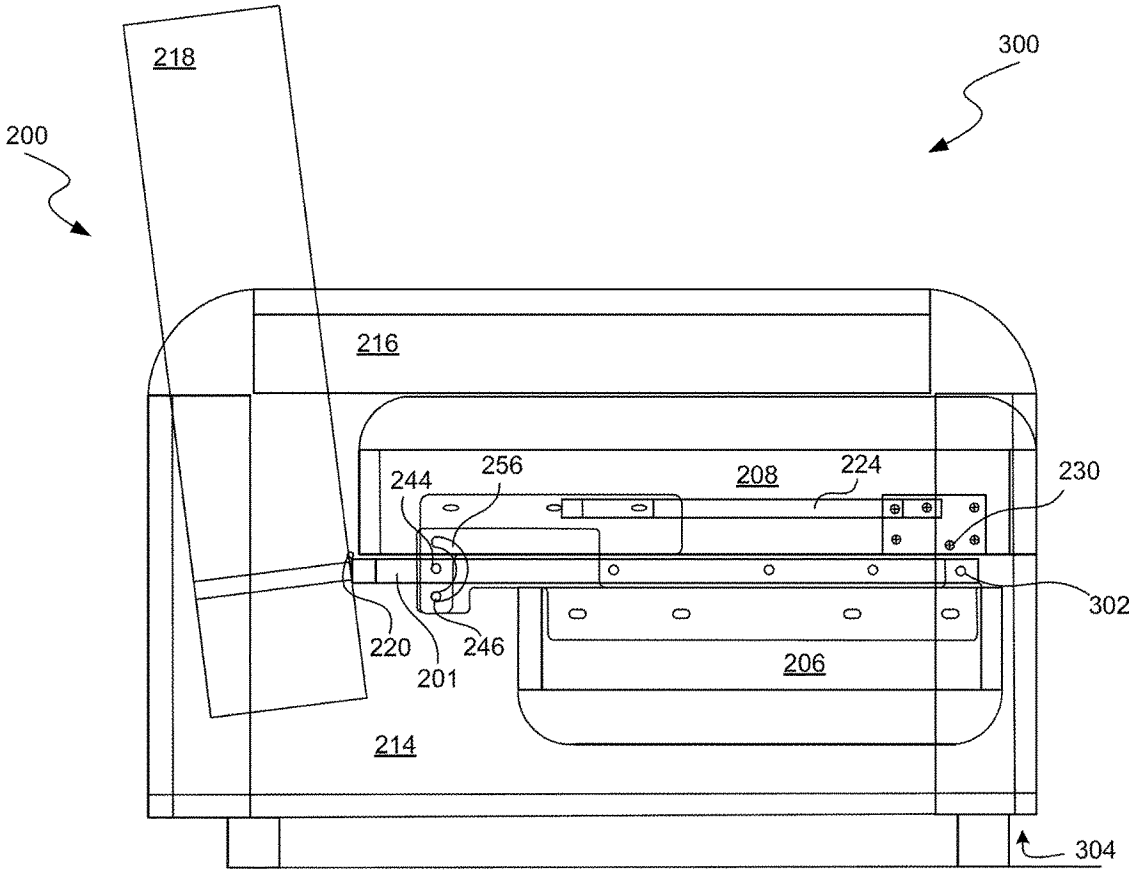
FIG. 3 depicts a side elevation, line view of the convertible sofa of FIG. 2.

The convertible sofa 200 is shown in FIG. 2 with the bed frame 201 in the sleeper position 202. The bed frame 201 includes a head frame section 204, a torso frame section 206, and a leg frame section 208. Each of the head frame section 204, the torso frame section 206, and the leg frame section 208 have a top side and a bottom side in the sleeper position, which may be identified by a numerical designator (such as first top side and second top side) to differentiate the section. Each of the head frame section 204, the torso frame section 206, and the leg frame section 208 have opposed sides. Thus, for example, the torso frame section 206 has a first side and a second side opposed to the first side. The first side is adjacent a side of the head frame section 204. The second side is adjacent a side of the leg frame section, which side of the leg frame section may be designated as a third side, etc. In this particular exemplary embodiment, the head frame section 204 comprises the back rest 218 of the sofa 200. The back rest 218 includes a frame and cushion component. Each of the frame sections 206 and 208 support a cushion 210 or the like. The cushions 210 could be removable or affixed to the frame section as a matter of design choice. The convertible sofa 200 includes a sofa casing 212 including a sofa base 214 with arm rests 216 extending upwards from the sofa base 214. The back rest 218, which comprises a frame and cushions, rests on the sofa casing 212, which may include frame members 211 contained in the sofa base 214. In the sleeper position 202, as shown, the back rest 218 is pivoted about axle 220 to a horizontal or supine position. In the sofa position, the back rest 218 would be pivoted to the upright or vertical position (as shown in FIG. 3). Cushions 210 would be removed from, for example, the torso section 206 and placed against the head frame section 204 for comfort. Alternatively, the cushions on the back rest 218 may be affixed to the front or back of the back rest 218 or removably coupled to the back rest 218 to be flipped from the sofa position to the sleeper position as needed. Still alternatively, the cushions on back rest 218 may be stitched to the top edge of the back rest 218 and flipped over the top edge from one position to the other. The head frame section extends from a back of the sofa base 214 to a front of the sofa base 214. The sofa base 214 of the casing 212 (or equivalent portion of the sofa 200) generally provides a support for the junction or seam between the head frame 204 and the torso frame 206 that limits or completely inhibits downward movement or bowing of the frame at that junction or seam.

The leg frame section 208 has an end portion 222 distal to the sofa base 214 in the sleeper configuration as shown in FIG. 2. The end portion 222 is support by a plurality of legs 224. The leg frame section 208 may be supported by two or three legs 224. While U-shaped legs consistent with FIG. 1 are possible, the technology of the present application generally provides legs that are generally straight poles, in some embodiments with a flared or cushioned foot. Providing a singular leg allows a single manufacturing item for beds having different lengths and widths. For example, when providing double, queen, and king size convertible sofas, a U-shaped leg for each different size bed would be of a different size. Whereas, when providing two or three legs comprising a vertical pole, the singular legs may all be identical regardless of the length and width of the bed. Thus, a double convertible sofa bed may have, for example, two (2) legs 224 whereas a king sized sofa bed may have, for example, three (3) legs 224.

When two legs 224 are provided, the legs 224 are on opposing left and right sides of the leg frame section 208. When three or more legs 224 are provided, the legs 224 include at least one leg positioned between the outer left and right legs. Typically, the legs 224 would be symmetrically placed. Each leg 224 is pivotally coupled to a bracket 226 on the leg frame section 208. For example, a fastener 228, such as a pin, bolt, or rivet, may couple the leg 224 to the bracket 226 such that the leg 224 can pivot about the fastener 228. The bracket 226 has at least one stop 230 to inhibit the leg from being over extended. The stop 230 may be a bolt, rivet, or protrusion. As can be seen, the leg 224 is slightly canted towards the end portion 222 such that gravity holds the leg 224 firmly against the stop 230 when deployed. In the stowage position (e.g., folded up parallel to the plane defined by the leg frame section), a clip may hold the leg 224 up.

The torso frame section 206 and the leg frame section 208 are pivotally coupled by a bridge joint 232. The bridge joint 232 includes a leg (or first) portion 234 and a torso (or second) portion 236. The leg portion 234 comprises a bracket 238 fixedly coupled to the leg frame section 208 by fasteners 240, such as bolts or rivets, and a pivot beam 242 extending down from the bracket 238. The pivot beam 242 includes a pivot 244 and an anti-buckling pin 246, which will be explained below. The leg portion 234 has a generally L-shape although other shapes, including square, rectangular, triangular, circular or the like are possible. In other words, the pivot beam 242 could be a section of a larger rectangular or square leg portion 234 where the leg portion 234 has a portion extending below the leg frame section 208. The pivot 244 or axle may be formed from a bolt, rivet, pin, protuberance or the like and is generically referred to as a pivot pin 244. The anti-buckling pin 246 similarly may be formed by a bolt, rivet, pin, protuberance or the like and is generically referred to as a pin. The torso portion 236 comprises a bracket 248 fixedly coupled to the torso frame portion by fasteners 250, such as bolts or rivets. The torso portion 236 further has a bridge beam 252 extending down from the bracket and forward to a position below the leg frame section and adjacent to the pivot beam 242. The bridge beam 252 may be an extension of the bracket 248 rather than extending down from and forward of the bracket 248 making a large rectangular torso portion 236 instead of one have a generally Z shape as shown. The bridge beam 252 terminates in a pivot guide 254. The pivot guide 254 comprises a track 256 in which the anti-buckling pin 246 moves as the leg frame section 208 unfolds or pivots about the pivot pin 244 relative to the torso frame section 206. The track 256 partially or fully encircles the pivot pin 244. The track 256 in this exemplary embodiment is 180° around the pivot 244 to allow for full travel without excessive track 256. The anti-buckling pin 246 travels along the track 256 as the leg frame portion 208 folds or unfolds with respect to the torso frame portion 206 as the bed frame moves between the sleeper position 202, shown in FIG. 2, and the sofa position, shown in FIG. 3. To facilitate folding of the frames, the pivot guide 254 extends along the bracket 238 of the leg portion 234.

The bridge joint 232 provides a brace between the torso frame section 206 and the leg frame section 208 under the seam 260. The bridge joint 232 resists bending or bowing in a downward direction between the torso frame section 206 and the leg frame section 208. In particular, the bridge beam 252 prevents from further downward movement because the anti-buckling pin 246 engages the end of the track 256 that stops the bridge beam 252 from further movement, which inhibits downward bending or bowing of the seam or junction.

With reference to FIG. 3, the convertible sofa 200 is shown in the sofa or sitting position 300. The back rest 218 is pivoted about axle 220 to the upright or sitting position 300. The torso frame section 206 is folded over a pivot axle 302 at the forward edge 304 of the sofa base 214. When in the sitting position, the torso frame section 206 is contained within the sofa base 214. The bridge joint 232 is folded over on itself in the sitting position 300. In particular, the leg portion 234 and the torso portion 236 pivot or fold with respect to each other. The anti-buckling pin 246 travels during the folding along the track 256 to the opposite end. As can be appreciated, the bridge joint is one example of a means for pivotally coupling the torso frame section and leg frame section of the bed frame. The torso frame 206 is inverted in the sofa or sitting position (FIG. 3) as compared to the alignment when in the sleep position (FIG. 2).

Figure 4:
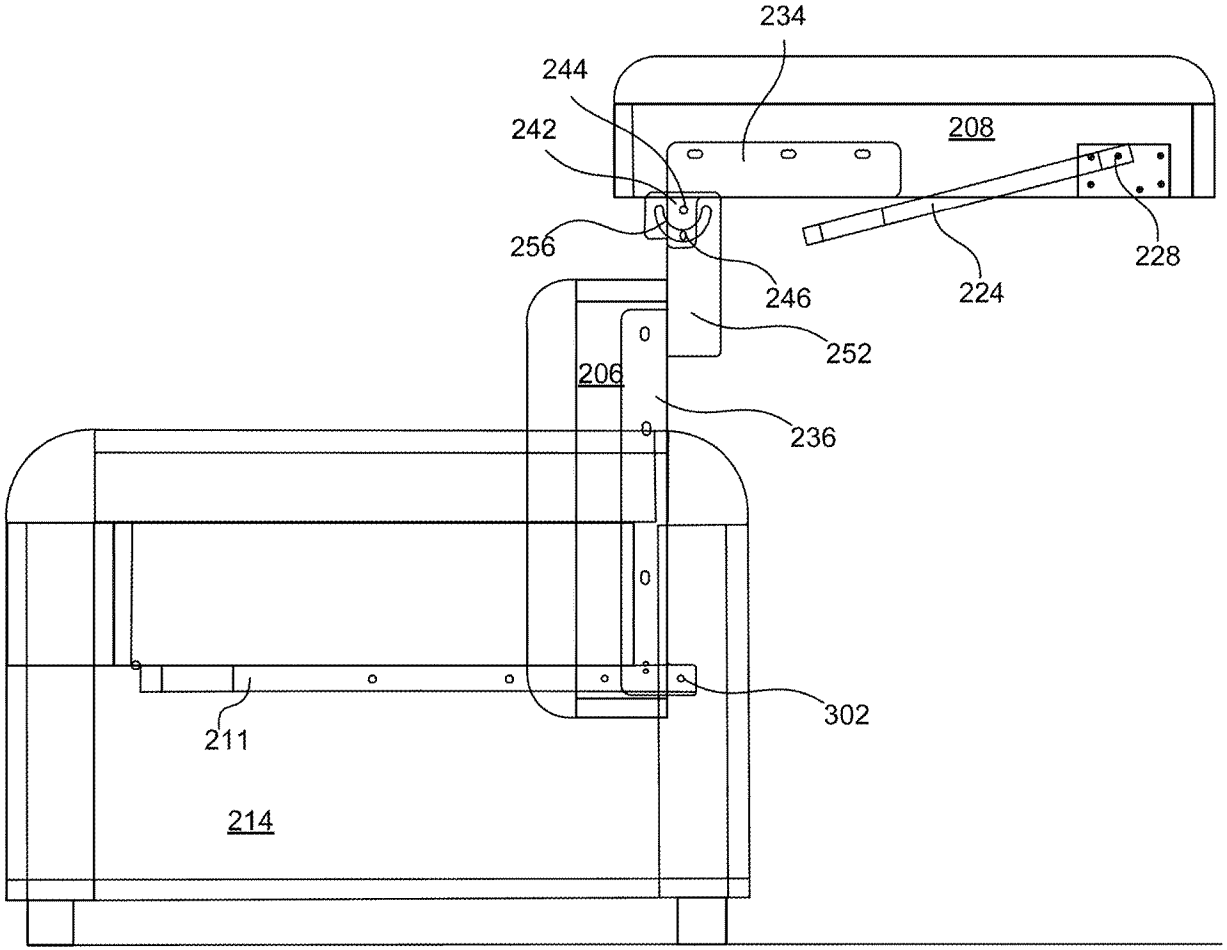
FIG. 4 depicts a side elevation, line view of the convertible sofa of FIG. 2.
Figure 5:
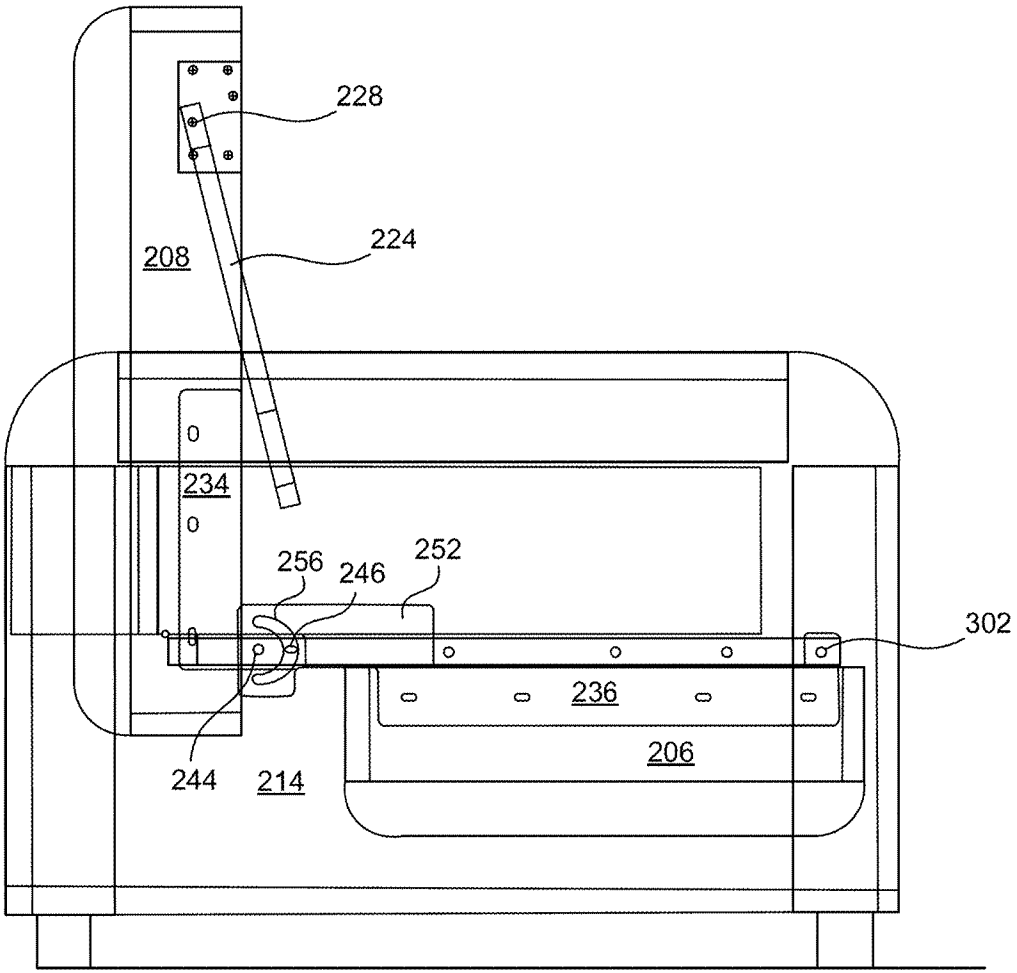
FIG. 5 depicts a side elevation, line view of the convertible sofa of FIG. 2.
Figure 6:
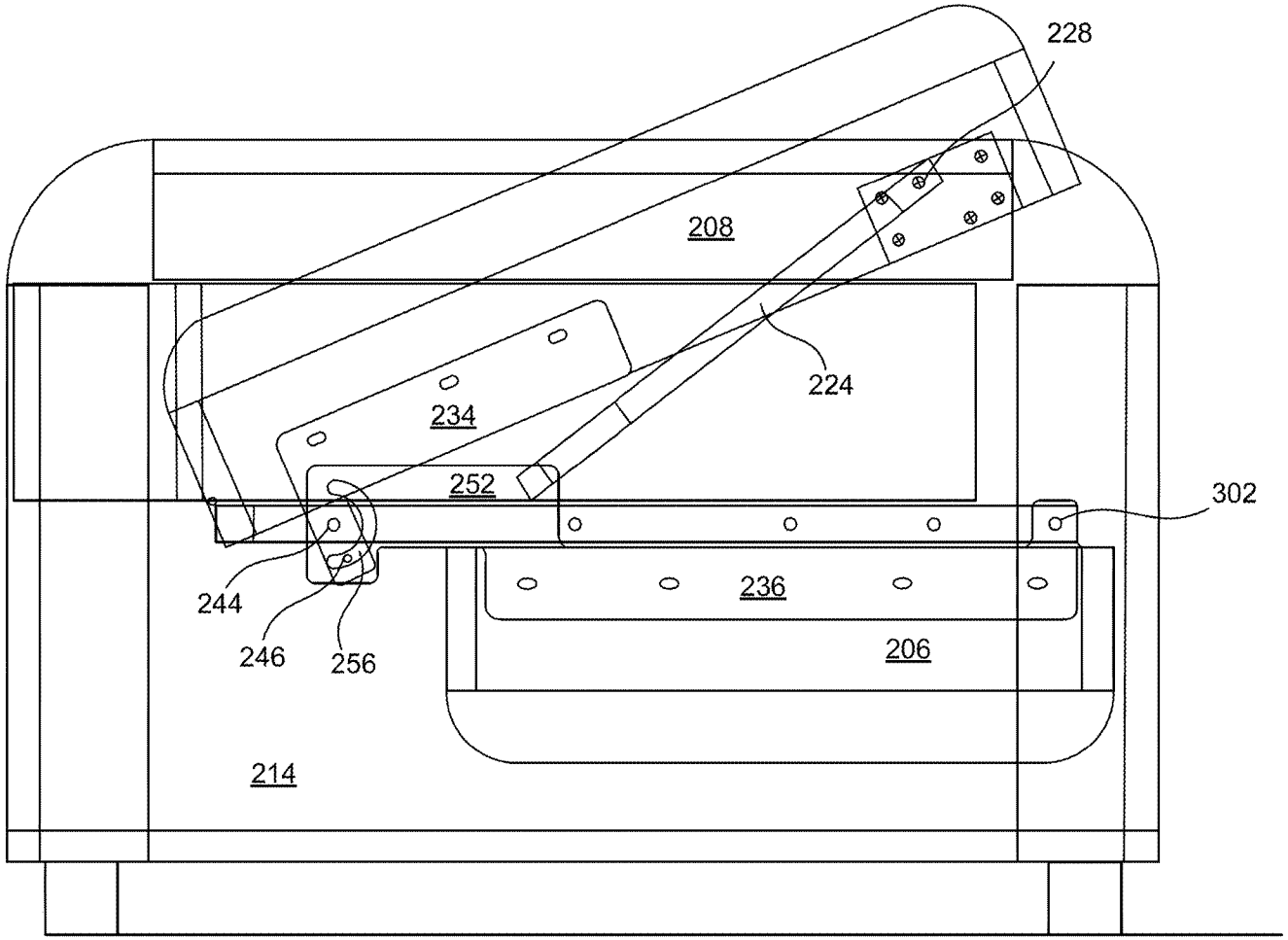
FIG. 6 depicts a side elevation, line view of the convertible sofa of FIG. 2.

With reference to FIGS. 4, 5, and 6, the folding operation of the convertible sofa 200 is visualized. While described with reference to moving the convertible sofa from the sleeper position 202 to the sitting position 300, the operations would be reversed to unfold the convertible sofa 200 from the sitting position 300 to the sleeper position 202 and will, therefore, not be explained separately. As can additionally be appreciated, the bridge joint 232 was described and attached to the sofa 200 in view of the particular orientation of the torso frame portion 206 and the leg frame portion 208 with respect to each other. The bridge joint 232 could be oriented for other configurations and folding relationships without undue experimentation.

FIG. 4 shows initially moving the bed frame 201 from the sleeper position 202 to the sitting position 300. The leg frame section 208 is lifted vertically. The leg 224 is pivoted up to the leg frame section 208 about fastener 228 by either manual operation or automatically by a spring or the like. Lifting the leg frame section 208 causes the torso frame section 206 to pivot up about pivot axle 302, which is contained in the sofa base 214 on a frame member 211. Rather than lifting the leg frame section 208, the leg frame section 208 could be moved horizontally to push the torso frame section 206 to pivot about the pivot axle 302. The bridge joint 232 pivots such that the torso portion 236 and the leg portion 234 pivot with respect to each other about pivot 244. The anti-buckling pin 246 begins traveling in the track 256 from a stop side to the opposite side, and in FIG. 4, the anti-buckling pin 246 has traveled approximately ½ the distance of the track 256.

The torso frame section 206 has been pivoted about pivot axle 302 into the sofa base 214 in FIG. 5. As shown, the initial lifting of the leg frame section 208 and the pivoting of the torso frame section essentially pivots the leg frame section 208 90 degrees with respect to the torso frame section 206 and pivots the torso frame section 206 90 degrees to 180 degrees with respect to the sofa base 214 until the torso frame section 206 is flipped and stored in the sofa base 214. The frame sections, however, may pivot a different amount depending on the actual operation performed.

FIG. 6 shows the convertible sofa 200 mostly folded to the sitting position 300. The anti-buckling pin 246 has traveled about three quarters of the way in track 256 from the stop position to the opposite end. The bridge beam 252 forms a guide for the leg frame section 208 as it is folded into the sitting position 300. When fully collapsed into the sitting position, the anti-buckling pin 246 will have traveled the remaining distance in the track 256 (although the track could extend beyond the require amount). As can be appreciated, the cushion support side of the torso frame section 206 is inverted with respect to the cushion support side of the leg frame section 208 when the frames are in the sitting position 300. It should be noted that while shown as discrete folding steps, the movement of the various sections of the frame would be more fluid such that specific angles and orientations may or may not be realized.

Although the technology has been described in language that is specific to certain structures, materials, and methodological steps, it is to be understood that the invention defined in the appended claims is not necessarily limited to the specific structures, materials, and/or steps described. Rather, the specific aspects and steps are described as forms of implementing the claimed invention. Since many embodiments of the invention can be practiced without departing from the spirit and scope of the invention, the invention resides in the claims hereinafter appended. Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

The invention claimed is:

1. An apparatus, comprising:

a first frame section having a first top side, a first bottom side opposite the first top side, a first side and a second side opposite the first side;

a second frame section having a second top side, a second bottom side opposite the second top side, a third side and a fourth side opposite the third side; and a bridge joint pivotally coupling the first frame section and the second frame section, wherein the bridge joint comprises:

a second frame portion fixedly coupled to the second bottom side of the second frame section proximal the third side, the second frame portion comprising a pivot pin located below and proximal the second bottom surface and an anti-buckling pin located below the pivot pin; and a first frame portion fixedly coupled to the first bottom side of the first frame section proximal the second side, the first frame portion comprising a track at least partially encircling the pivot pin, wherein the first frame section and the second frame section can pivot from a folded position where the first bottom side is vertically aligned with the second bottom side to an unfolded position where the first bottom side is horizontally aligned with the second bottom side wherein the bridge joint resists bowing between the first and second frame sections.

2. The apparatus of claim 1 wherein the apparatus is a convertible sofa and the first frame section comprises a torso frame section and the second frame section comprises a leg frame section.

3. The apparatus of claim 2 further comprising:

a plurality of legs pivotally coupled to the leg frame section proximal the fourth side wherein each of the plurality of legs is a generally vertical pole.

4. The apparatus of claim 3 further comprising a plurality of brackets corresponding to the plurality of legs wherein each of the plurality of brackets comprises a pivot pin and a stop, and wherein each of the plurality of legs is pivotally coupled to the corresponding plurality of brackets at the pivot pin.

5. The apparatus of claim 4 wherein each of the plurality of legs are canted such that the leg frame section causes each of the plurality of legs to hold firmly against the stop.

6. The apparatus of claim 1 wherein:

the second frame portion comprises a bracket fixedly coupling the second frame portion to the second frame section and a pivot beam having the pivot pin and the anti-buckling pin.

7. The apparatus of claim 6 wherein the first frame portion comprises a bracket fixedly coupling the first frame portion to the first frame section and a bridge beam that terminates in a pivot guide having the track.

8. The apparatus of claim 7 wherein the second frame portion has a generally L shape and the first frame portion has a generally Z shape.

9. The apparatus of claim 1 wherein the apparatus is selected from a group of apparatuses consisting of: a chair, a table, or a recliner.

10. A sleeper sofa comprising:

a sofa casing, the sofa casing comprising at least a sofa base;

a back rest coupled to the sofa casing;

a bed frame comprising:

a torso frame section, the torso frame section pivotally coupled to the sofa casing on a first side of the torso frame section, the torso frame section having a second side opposite the first side;

a bridge joint; and a leg frame section pivotally coupled to the second side of the torso frame section by the bridge joint, wherein the bridge joint extends from the torso frame section to the leg frame section; and wherein the sleeper sofa has a sitting position where the torso frame section is contained in the sofa base and the leg frame section is aligned above the torso frame section and a sleeping position where the torso frame section is pivoted out of the sofa base and the leg frame section is pivotally unfolded from the torso frame section to form a horizontal sleeping surface such that the bridge joint inhibits a bowing of the horizontal sleeping surface at a junction between the torso frame section and the leg frame section; and wherein the bridge joint comprises a leg portion having a bracket fixedly coupled to the leg frame section and a pivot beam, and the pivot beam comprises a pivot pin and an anti-buckling pin; and a torso portion having a bracket fixedly coupled to the torso frame section and a bridge beam, the bridge beam having a pivot guide wherein the pivot pin and the anti-buckling pin are operatively coupled to allow the torso frame section and the leg frame section to pivot with respect to each other.

11. The sleeper sofa of claim 10 wherein the sofa casing comprises a pair of arm rests.

12. The sleeper sofa of claim 10 wherein the back rest is pivotally coupled to the sofa base on an axle, and wherein the back rest has a sitting position where the back rest is generally vertical and a sleeper position where the back rest is pivoted about the axle to form a portion of the horizontal sleeping surface.

13. The sleeper sofa of claim 12 wherein the torso frame section in the sitting position is inverted relative to the torso frame section in the sleeper position.

14. The sleeper sofa of claim 10 further comprising at least one leg pivotally coupled to a bottom of the leg frame section wherein the at least one leg has a first position generally parallel to a plane of the leg frame section for storage and a second position generally perpendicular to the plane of the leg frame section for support.

15. The sleeper sofa of claim 14 wherein the at least one leg is a plurality of identical legs wherein each of the identical legs is a generally vertical pole.

* * * * *